US011723405B2

(12) United States Patent
Otiaba et al.

(10) Patent No.: US 11,723,405 B2
(45) Date of Patent: Aug. 15, 2023

(54) LIQUID STORAGE TANK FOR A VAPOR PROVISION SYSTEM

(71) Applicant: NICOVENTURES TRADING LIMITED, London (GB)

(72) Inventors: Kenny Otiaba, London (GB); David Leadley, London (GB)

(73) Assignee: Nicoventures Trading Limited, London (GB)

( * ) Notice: Subject to any disclaimer, the term of this patent is extended or adjusted under 35 U.S.C. 154(b) by 846 days.

(21) Appl. No.: 16/336,131

(22) PCT Filed: Sep. 13, 2017

(86) PCT No.: PCT/GB2017/052687
§ 371 (c)(1),
(2) Date: Mar. 25, 2019

(87) PCT Pub. No.: WO2018/060675
PCT Pub. Date: Apr. 5, 2018

(65) Prior Publication Data

US 2019/0223508 A1 Jul. 25, 2019

(30) Foreign Application Priority Data

Sep. 28, 2016 (GB) ..... 1616430

(51) Int. Cl.
*A24F 40/42* (2020.01)
*A24F 40/10* (2020.01)

(52) U.S. Cl.
CPC ..... *A24F 40/42* (2020.01); *A24F 40/10* (2020.01)

(58) Field of Classification Search
CPC ..... A24F 40/42; A24F 40/485; A24F 40/10; A24F 40/30; A24F 40/05; A61M 15/06; A61M 11/042; A61M 11/002
See application file for complete search history.

(56) References Cited

U.S. PATENT DOCUMENTS 5,916,493 A 6/1999 Miller
6,131,570 A 10/2000 Schuster et al.
(Continued)

FOREIGN PATENT DOCUMENTS

CN 2320829 Y 5/1999
CN 101557728 B 4/2011
(Continued)

OTHER PUBLICATIONS

WO2016033721A1_Description_Original_Doc (Year: 2016).*
(Continued)

*Primary Examiner* — Marcus E Harcum
(74) *Attorney, Agent, or Firm* — Patterson Thuente P.A.

(57) ABSTRACT

A liquid storage tank of an electronic vapor provision device includes one or more boundary walls defining an interior volume of the tank for accommodating source liquid to be vaporized in the electronic vapor provision device; and one or more baffles, each baffle protruding from an inner surface of the boundary wall into the interior volume to impede a flow of source liquid between portions of the interior volume between which the baffle is located. The tank may be included in an electronic vapor provision device or in a component for an electronic vapor provision device such as a cartomizer.

20 Claims, 3 Drawing Sheets

(56) References Cited

U.S. PATENT DOCUMENTS

| | | | | |
|---|---|---|---|---|
| 6,325,475 | B1 | 12/2001 | Hayes et al. | |
| 10,869,505 | B2 * | 12/2020 | Borkovec | A24F 40/30 |
| 2001/0032647 | A1 | 10/2001 | Schuster et al. | |
| 2011/0047957 | A1 | 3/2011 | Richard | |
| 2012/0111347 | A1 | 5/2012 | Hon | |
| 2014/0109898 | A1 * | 4/2014 | Li | A61M 15/06 128/200.14 |
| 2014/0130816 | A1 | 5/2014 | Liu | |
| 2014/0144429 | A1 | 5/2014 | Wensley et al. | |
| 2014/0150783 | A1 | 6/2014 | Liu | |
| 2014/0196717 | A1 | 7/2014 | Liu | |
| 2014/0286630 | A1 | 9/2014 | Buchberger | |
| 2014/0334803 | A1 * | 11/2014 | Li | A61M 15/06 392/394 |
| 2014/0360514 | A1 | 12/2014 | Zhu | |
| 2015/0013702 | A1 | 1/2015 | Liu | |
| 2015/0040925 | A1 | 2/2015 | Saleem et al. | |
| 2015/0083147 | A1 | 3/2015 | Schiff et al. | |
| 2015/0157053 | A1 | 6/2015 | James | |
| 2015/0237916 | A1 | 8/2015 | Farine et al. | |
| 2015/0282529 | A1 * | 10/2015 | Li | A61M 15/06 131/273 |
| 2015/0296885 | A1 | 10/2015 | Liu | |
| 2015/0305407 | A1 | 10/2015 | Li et al. | |
| 2015/0305408 | A1 | 10/2015 | Kimree | |
| 2015/0313288 | A1 | 11/2015 | Kimree | |
| 2016/0073692 | A1 | 3/2016 | Alarcon et al. | |
| 2016/0366943 | A1 | 12/2016 | Li et al. | |
| 2018/0020730 | A1 * | 1/2018 | Alarcon | A61M 11/042 131/329 |

FOREIGN PATENT DOCUMENTS

| | | | |
|---|---|---|---|
| CN | 203523810 | U | 4/2014 |
| CN | 103987285 | A | 8/2014 |
| CN | 104000306 | A | 8/2014 |
| CN | 203748684 | U | 8/2014 |
| CN | 203828071 | U | 9/2014 |
| CN | 203884696 | U | 10/2014 |
| CN | 204466909 | U | 7/2015 |
| CN | 204682534 | U | 10/2015 |
| CN | 204994622 | U | 1/2016 |
| DE | 202014101126 | U1 | 4/2014 |
| DE | 202014106041 | U1 | 1/2015 |
| EP | 2724630 | A1 | 4/2014 |
| EP | 2921065 | A1 | 9/2015 |
| EP | 3009018 | A1 | 4/2016 |
| EP | 3050446 | A1 | 8/2016 |
| EP | 3061356 | A1 | 8/2016 |
| EP | 3069620 | A1 | 9/2016 |
| EP | 3108759 | A1 | 12/2016 |
| EP | 3158880 | A1 | 4/2017 |
| EP | 3518696 | B1 | 11/2020 |
| JP | H1089180 | A | 4/1998 |
| JP | 2012527109 | A | 11/2012 |
| JP | 2015509718 | A | 4/2015 |
| JP | 2017510260 | A | 4/2017 |
| JP | 2019512225 | A | 5/2019 |
| KR | 20120109256 | A | 10/2012 |
| KR | 20160096745 | A | 8/2016 |
| RU | 2132629 | C1 | 7/1999 |
| WO | WO-2010130993 | A2 | 11/2010 |
| WO | WO-2011050964 | A1 | 5/2011 |
| WO | WO2013057185 | A1 | 4/2013 |
| WO | WO-2013126777 | A2 | 8/2013 |
| WO | WO-2013159245 | A1 | 10/2013 |
| WO | WO-2014147114 | A1 | 9/2014 |
| WO | WO-2015026948 | A1 | 2/2015 |
| WO | WO-2015071703 | A1 | 5/2015 |
| WO | WO-2015112750 | A1 | 7/2015 |
| WO | WO-2015117704 | A1 | 8/2015 |
| WO | WO-2015140012 | A1 | 9/2015 |
| WO | WO2015177044 | | 11/2015 |
| WO | WO-2016014652 | A1 | 1/2016 |
| WO | WO-2016033721 | A1 | 3/2016 |
| WO | WO-2016040575 | A1 | 3/2016 |
| WO | WO-2016099276 | A1 | 6/2016 |
| WO | WO-2016108693 | A1 | 7/2016 |
| WO | WO-2016108694 | A1 | 7/2016 |
| WO | WO-2016135331 | A1 | 9/2016 |
| WO | WO-2016141592 | A1 | 9/2016 |
| WO | WO-2017037457 | A1 | 3/2017 |
| WO | WO-2017153579 | A1 | 9/2017 |

OTHER PUBLICATIONS

International Search Report and Written Opinion, Application No. PCT/GB/2017/052687, dated Jan. 2, 2018, 14 pages.
International Preliminary Report on Patentability, Application No. PCT/GB/2017/052687, dated Oct. 11, 2018, 7 pages.
Communication pursuant to Article 94(3) EPC for Application No. 18759708.3, dated Mar. 12, 2021, 4 pages.
Decision of Grant dated Dec. 19, 2019 and Search report for Russian Patent Application No. 2019123009, 12 pages.
Decision to Grant dated Sep. 18, 2020 for Russian Application No. 2020107622, 8 pages.
Gesamtkatalog Texgilles: "Gesamtkatalog 2015 Wir bewegen und kontrollieren Ihr Garn", Jan. 1, 2015, XP055522016, Retrieved from the Internet: URL:https://www.texgilles.de/download.php/105/Prospekt_Garnqualitat.pdf [retrieved on Nov. 7, 2018].
International Preliminary Report on Patentability for Application No. PCT/GB2018/052343, dated Aug. 12, 2019, 5 pages.
International Preliminary Report on Patentability for Application No. PCT/GB2018/052344, dated Mar. 5, 2020, 8 pages.
International Search Report and Written Opinion for Application No. PCT/GB2018/052343, dated Oct. 18, 2018, 9 pages.
International Search Report and Written Opinion for Application No. PCT/GB2018/052344, dated Nov. 21, 2018, 10 pages.
International Preliminary Report on Patentability for Application No. PCT/GB2018/050061, dated Jan. 8, 2019, 19 pages.
International Search Report and Written Opinion for Application No. PCT/GB2018/050061, dated Apr. 18, 2018, 19 pages.
Notice of Reason for Refusal for Japanese Application No. 2019-534366 dated Oct. 13, 2020, 5 pages.
Office action and Search Report dated Jun. 9, 2020 for Russian Application No. 2020107622, filed Aug. 17, 2018, 8 pages.
Office Action and Search Report dated May 27, 2020 for Russian Application No. 2020107622, 8 pages.
Office Action dated Jul. 21, 2020 for Canadian Application No. 3,038,022, 6 pages.
Office Action for Chinese Application No. 201780059545.1, dated Jan. 25, 2021, 6 pages.
Office Action dated Feb. 16, 2021 for Japanese Application No. 2019-515908, 5 pages.
Search Report dated Jun. 10, 2020 for Japanese Application No. 2019-515908, 13 pages.
Search Report under Section 17(5) dated Feb. 15, 2018 for Great Britain Application No. 1713679.7, 3 pages.
Search Report under Section 17(5) dated Feb. 21, 2018 for Great Britain Application No. 1713681.3, 4 pages.
Toyota Textile Machinery Division, "Ring Spinning Frame," Jan. 1, 2016, XP055522013, Retrieved from the Internet: URL:http://toyotatextilemachinery.com/wp-content/uploads/2016/11/RX300_E_2016.pdf[retrieved on Nov. 7, 2018].
Notice of Opposition mailed Aug. 16, 2021 for European Application No. 17771527.3 (EP3518696), 35 pages.
Notice of Reasons for Rejection for Japanese Application No. 2021-044517, dated May 24, 2022, 8 pages.

* cited by examiner

LIQUID STORAGE TANK FOR A VAPOR PROVISION SYSTEM

PRIORITY CLAIM

The present application is a National Phase entry of PCT Application No. PCT/GB2017/052687, filed Sep. 13, 2017, which claims priority from GB Patent Application No. 1616430.3, filed Sep. 28, 2016, which is hereby fully incorporated herein by reference.

TECHNICAL FIELD

The present disclosure relates to a liquid storage tank for electronic vapor provision systems, and systems and components therefore comprising such a tank.

BACKGROUND

Vapor provision systems such as electronic or e-cigarettes generally contain a reservoir of a source liquid containing a formulation, typically including nicotine, from which an aerosol (vapor) is generated, such as through vapor or other means. The system may have an aerosol source, sometime referred to as an atomizer, comprising a heating element or heater coupled to a portion of the source liquid from the reservoir. Electrical power is provided to the heater from a battery comprised within the vapor provision system, whereupon the heater temperature rises, the portion of source liquid is heated, and the vapor is generated for inhalation by the user.

Arrangements for delivering source liquid from the reservoir to the heater include the use of a wick or similar porous element which contacts the heater and also has one or more parts disposed inside the reservoir to absorb source liquid and transfer it towards the heater by wicking (capillary action). This liquid pathway should be maintained for efficient vapor generation. Some e-cigarettes have a source liquid reservoir formed from a quantity of porous material such as cotton wadding which is soaked with the source liquid. The source liquid can move readily through the porous material to the wick until it has been consumed. However, residual source liquid may remain in the reservoir material so that new source liquid refilled into the electronic cigarette is contaminated with the previous source liquid, making a change of source liquid type (flavor or nicotine strength, for example) difficult. An alternative arrangement in which the reservoir has the form of a tank that holds source liquid in a free-flowing state may therefore be preferred.

The wick or other arrangement for extracting source liquid from the reservoir has a particular location or locations at which it extends into the reservoir. With free-flowing source liquid held in a tank, there is the possibility that the source liquid will move away from this location and collect elsewhere in the tank. This is particularly true when the source liquid is partly consumed so the tank is partially empty. The region of the tank at which the remaining source liquid collects will depend on the orientation at which the user holds the e-cigarette, and this may result in the source liquid being remote from the wick so that it is not transferred to the heater for vaporization. Vapor generation ceases, even though source liquid is still available.

Arrangements that address this issue are therefore of interest.

SUMMARY

According to a first aspect of certain embodiments described herein, there is provided a liquid storage tank of an electronic vapor provision device, comprising: one or more boundary walls defining an interior volume of the tank for accommodating source liquid to be vaporized in the electronic vapor provision device; and one or more baffles, each baffle protruding from an inner surface of the boundary wall into the interior volume to impede a flow of source liquid between portions of the interior volume between which the baffle is located.

The or each baffle may be shaped such that a largest profile of the baffle lies in a plane non-parallel to a direction of the flow of source liquid between selected portions of the interior volume. The selected portions of the interior volume may be spaced along a longest dimension of the tank. For example, the or each baffle may be shaped such that the largest profile is orthogonal to the direction of the flow of source liquid between said selected portions of the interior volume.

The or each baffle may be shaped to present a flat surface to source liquid flowing between said portions of the interior volume. Alternatively or additionally, the or each baffle may be shaped to present a concave or recessed surface to source liquid flowing between the said portions of the interior volume. The concave or recessed surface may face towards a location at which source liquid is extracted from the tank for vaporization.

The or each baffle may be shaped to present to source liquid flowing between said portions of the interior volume a first surface and a second surface opposite to the first surface which is differently shaped from the first surface. One of the first and second surfaces may be sloped to protrude further from the inner surface closer to the other of the first and second surfaces. The sloped surface may face away from a location at which source liquid is extracted from the tank for vaporization.

One or more baffles may occupy a cross-sectional area which is in the range 25% to 75% of the cross-sectional area of the interior volume of the tank at the location of the one or more baffles.

Two or more baffles may be located at a same distance along a dimension of the tank. For example, the baffles may be arranged in at least two groups of two or more with the baffles in each group being located at a same distance along said dimension of the tank.

The tank may comprise at least two differently shaped baffles.

One or more of the boundary walls may comprise an outer boundary wall and an inner boundary wall that between them define an annular interior volume.

According to a second aspect of certain embodiments described herein, there is provided a vapor generating component for an electronic vapor provision system comprising a liquid storage tank according to the first aspect, and an atomizer assembly configured to extract, receive and vaporize source liquid from the liquid storage tank.

The atomizer assembly may comprise a heating element and a wick component to deliver source liquid from the liquid storage tank to the heating element for vaporization, wherein the electrical heating element and the wick component may be separate entities or the same entity.

According to a third aspect of certain embodiments described herein, there is provided an electronic vapor provision system comprising a liquid storage tank according to the first aspect or a vapor generating component according to the second aspect.

According to a fourth aspect of certain embodiments described herein, there is provided a liquid storage tank for an electronic vapor provision system comprising one or more walls defining a storage volume for holding source liquid; and one or more protruding elements each extending from an inner surface of a wall into the storage volume such that a bore of the tank at a level of one or more protruding elements is reduced by at least 50% by the presence of the protruding elements so as to inhibit a flow of source liquid along the bore. For example, the protruding elements may reduce the bore of the tank by 50% or more, or by 60% or more, or by 70% or more, or by 80% or more, or by 90% or more.

According to a fifth aspect of certain embodiments described herein, there is provided an electronic vapor provision system or a component therefore comprising a liquid storage tank according to the fourth aspect.

These and further aspects of certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, a liquid storage tank and a component or system comprising such a tank may be provided in accordance with approaches described herein which includes any one or more of the various features described below as appropriate.

BRIEF DESCRIPTION OF THE DRAWINGS

Various embodiments will now be described in detail by way of example only with reference to the accompanying drawings in which.

DETAILED DESCRIPTION

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) aerosol provision systems, such as e-cigarettes. Throughout the following description the terms "e-cigarette" and "electronic cigarette" may sometimes be used; however, it will be appreciated these terms may be used interchangeably with aerosol (vapor) provision system or device. Similarly, "aerosol" may be used interchangeably with "vapor".

Figure 1:
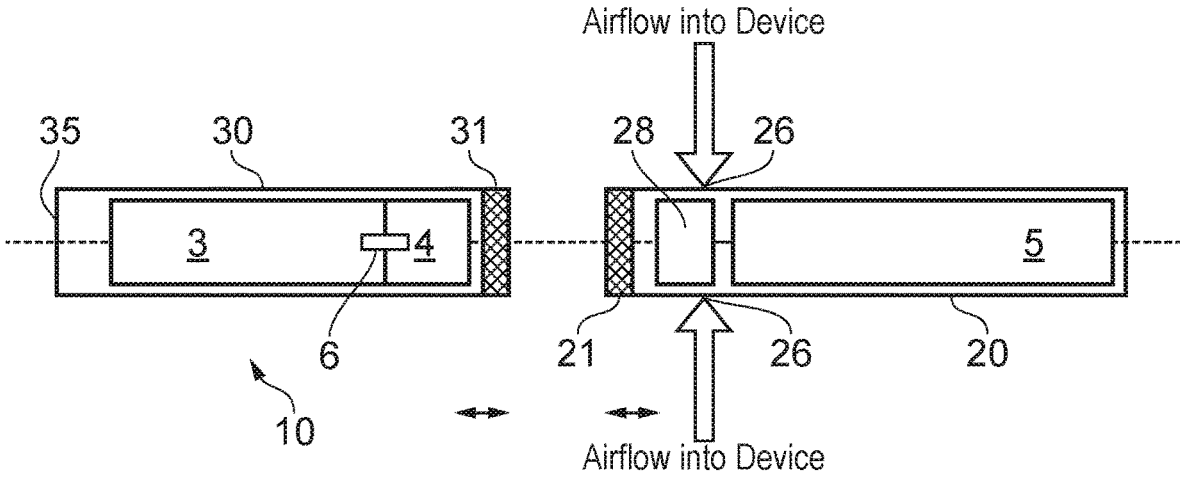
FIG. 1 shows a simplified schematic cross-sectional view of an example electronic cigarette or vapor provision device to which examples of the disclosure are applicable.

FIG. 1 is a highly schematic diagram (not to scale) of an example aerosol/vapor provision system such as an e-cigarette 10. The e-cigarette 10 has a generally cylindrical shape, extending along a longitudinal axis indicated by a dashed line, and comprises two main components, namely a control component or section 20 and a cartridge assembly or section 30 (sometimes referred to as a cartomizer) that operates as a vapor generating component.

The cartridge assembly 30 includes a reservoir 3 containing a source liquid comprising a liquid formulation from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. The reservoir 3 has the form of a storage tank, being a container or receptacle in which source liquid can be stored such that the liquid is free to move and flow within the confines of the tank. The reservoir may be sealed after filling during manufacture so as to be disposable after the source liquid is consumed, or may have an inlet port or other opening through which new source liquid can be added. The cartridge assembly 30 also comprises an electrical heating element or heater 4 located externally of the reservoir tank 3 for generating the aerosol by vaporization of the source liquid by heating. An arrangement such as a wick or other porous element 6 may be provided to deliver portions of source liquid from the reservoir 3 to the heater 4. The wick 6 has one or more parts located inside the tank 3 so as to be able to absorb source liquid and transfer it by wicking or capillary action to other parts of the wick 6 that are in contact with the heater 4. This liquid is thereby heated and vaporized, to be replaced by a new portion of liquid transferred to the heater 4 by the wick 3. The wick therefore extends through a wall that defines the interior volume of the reservoir tank 3, and might be thought of as a bridge between the reservoir 3 and the heater 4. A heater and wick (or similar) combination is sometimes referred to as an atomizer, and the source liquid in the reservoir and the atomizer may be collectively referred to as an aerosol source. The cartridge assembly 30 also includes a mouthpiece 35 having an opening or air outlet through which a user may inhale the aerosol generated by the heater 4.

The control section 20 includes a re-chargeable cell or battery 5 (referred to herein after as a battery) to provide power for electrical components of the e-cigarette 10, in particular the heater 4. Additionally, there is a printed circuit board 28 and/or other electronics for generally controlling the e-cigarette. The control electronics connect the heater 4 to the battery 5 when vapor is required, for example in response to a signal from an air pressure sensor or air flow sensor (not shown) that detects an inhalation on the system 10 during which air enters through one or more air inlets 26 in the wall of the control section 20. When the heating element 4 receives power from the battery 5, the heating element 4 vaporizes source liquid delivered from the reservoir 3 by the wick 6 to generate the aerosol, and this is then inhaled by a user through the opening in the mouthpiece 35. The aerosol is carried from the aerosol source to the mouthpiece 35 along an air channel (not shown) that connects the air inlet 26 to the aerosol source to the air outlet when a user inhales on the mouthpiece 35.

In this particular example, the control section 20 and the cartridge assembly 30 are separate parts detachable from one another by separation in a direction parallel to the longitudinal axis, as indicated by the solid arrows in FIG. 1. The parts 20, 30 are joined together when the device 10 is in use by cooperating engagement elements 21, 31 (for example, a screw or bayonet fitting) which provide mechanical and electrical connectivity between the control section 20 and the cartridge assembly 30. This is merely an example arrangement, however, and the various components may be differently distributed between the control section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections may be intended to be disposed of and replaced when exhausted (the reservoir is empty or the battery is flat, for example), or be intended for multiple uses enabled by actions such as refilling the reservoir and recharging the battery. Alternatively, the e-cigarette 10 may be a unitary device (disposable or refillable/rechargeable) that cannot be separated into two parts, in which case all components are comprised within a single body or housing. Embodiments of the present disclosure are applicable to any of these configurations and other configurations of which the skilled person will be aware.

Figure 2A:
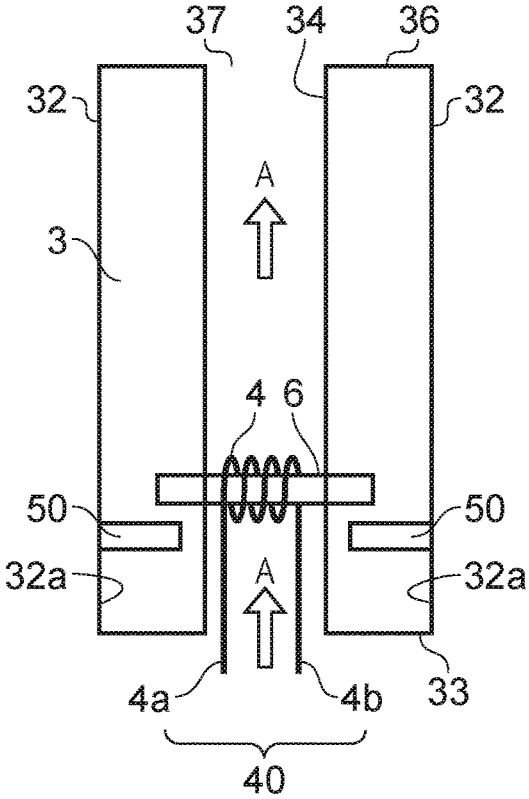
FIG. 2A shows a cross-sectional side view of an aerosol source incorporating baffles in accordance with an example.
Figure 2B:
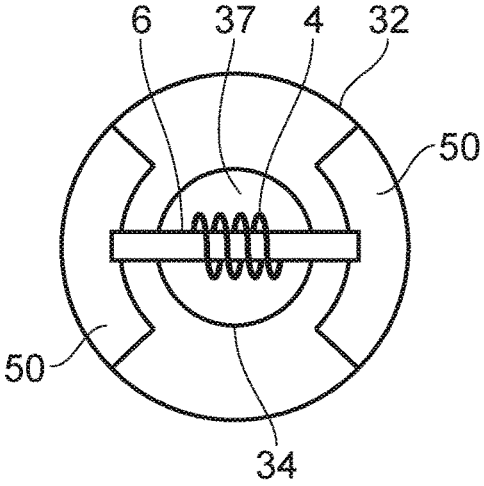
FIG. 2B shows a view from above of the example aerosol source of FIG. 2A.

The example device in FIG. 1 is presented in a highly schematic format. FIGS. 2A and 2B shows a more detailed representation of an aerosol source according to an example, indicating relative positions of the tank, heater and wick.

FIG. 2A shows a cross-sectional side view of an aerosol source. A reservoir tank 3 has an outer wall 32 and an inner wall 34, each of which is generally cylindrical. The inner wall 34 is centrally disposed within the outer wall 32 to define an annular space between the two walls; this is the interior volume of the tank 3 intended to hold source liquid. The tank is closed at its lower end (in the orientation depicted) by a bottom wall 33 and at its top end by an upper wall 36. The central space encompassed by the inner wall 34 is an airflow passage or channel 37 which at its lower end receives air drawn into the electronic cigarette (such as via air intakes 26 shown in FIG. 1), and at its upper end delivers aerosol for inhalation (such as through the mouthpiece 35 in FIG. 1).

Disposed within the airflow channel 37 is an atomizer 40 comprising a heater 4 and a wick 6. The wick, an elongate porous element that may, for example, be rod-shaped and formed from fibers, is arranged across the airflow passage (shown as closer to the lower end of the tank 3, but it may be positioned higher) so that its ends pass through apertures in the inner wall 34 and reach into the interior volume of the tank 3 to absorb source liquid therein. The apertures (not shown) are sealed so that source liquid does not leak from the tank 3 into the airflow channel 37. The heater 4 is an electrically powered heating element in the form of a wire coil wrapped around the wick 6. Connecting leads 4*a*, 4*b* join the heater to a circuit (not shown) for the provision of electrical power from a battery. The aerosol source will be disposed within the housing of a cartridge assembly section of an electronic cigarette, with a mouthpiece arranged at its top end and a controller and battery arranged at its lower end (possibly in a separable component). Note that the outer wall 32 of the tank may or may not also be a wall of the cartridge assembly housing. If these walls are shared, the cartridge assembly may be intended to be disposable when the source liquid has been consumed, to be replaced by a new cartridge assembly connectable to an existing battery section, or may be configured so that the reservoir tank 3 can be refilled with source liquid. If the tank wall and the housing wall are different, the tank 3 or the whole aerosol source may be replaceable within the housing when the source liquid is consumed, or may be removable from the housing for the purpose of refilling. These are merely example arrangements and are not intended to be limiting.

In use, when the aerosol source within its assembly housing is joined to a battery section (separably or permanently depending on the e-cigarette design), and a user inhales through the mouthpiece, air drawn into the device enters the airflow channel 37. The heater 4 is activated to produce heat; this causes source liquid brought to the heater 4 by the wick 6 to be heated to vaporization. The vapor is carried by the flowing air along the airflow channel 37 towards the mouthpiece of the device to be inhaled by the user. The arrows A indicate the airflow.

Note that the wick and heater shown are examples only; other configurations may be used as preferred.

It will be appreciated from FIG. 2A that as the source liquid is consumed, the tank 3 begins to empty and the remaining source liquid is able to move and flow inside the tank 3. This will occur during use and carrying of the e-cigarette such as when the user moves the e-cigarette to and from his mouth, and into and out of a pocket or bag. Depending on the relative configuration of the components and the orientation of the e-cigarette adopted in use, there may come a time when the unconsumed source liquid occupies a volume within the tank into which the ends of the wick do not reach, so the source liquid is not longer reliably delivered to the heater by the wick. A reorientation of the e-cigarette will be needed to move the source liquid and allow the wick to absorb more source liquid; this may be inconvenient and disruptive for the user.

Accordingly, the aerosol source of FIG. 2A also comprises a pair of baffles 50. Each baffle 50 has the form of a protrusion extending from the inner surface 32*a* of the outer wall 32 into the interior volume of the tank 3 where the source liquid is stored. They are positioned each at the same height in the tank 3, that is, at the same distance from the end walls 33, 36 (top and bottom) of the tank 3, but are closer to the lower end of the tank, lying between the level of the wick 6, where the source liquid is extracted from the tank, and the bottom wall 33. The baffles 50 are positioned opposite to one another across the width of the tank 3.

The baffles are shaped and oriented so as to be relatively thin in the longitudinal direction of the tank 3 (the tank's longest dimension), and relatively wide in the orthogonal direction. The elongate shape of the tank, and typically orientations of an e-cigarette in use, mean that there will likely be movement of source liquid inside the tank along the length (height) of the tank, between upper and lower portions of the interior volume, such as portions above and below the wick. Thus, the largest profile of the baffles is presented to liquid flowing in this manner. Note that in other shapes or configurations of tank, a predominant or common direction of liquid flow or movement may not be along a longest dimension of the tank. In such a case, the baffles may be oriented accordingly so that the largest profile is still presented to this main direction of liquid flow. Baffles may also be positioned other than with the largest profile in this orientation if desired. In other words, for two selected portions of the interior volume between which liquid may flow, the baffle may usefully be oriented so as to present its largest profile to this liquid movement, but may instead be positioned in a different configuration.

If the e-cigarette is held upright (as illustrated) or tilted at an angle as in typical use, the source liquid tends to flow to the lower portion of the tank 3. When only a small amount of source liquid remains, the source liquid may all collect below the level of the wick 6. The baffles act to impede the movement of liquid to the bottom of the tank, and act to at least temporarily hold back at least some of the source liquid so that it stays or pauses in the vicinity of the wick ends and can be absorbed. The flow of source liquid between the upper portion and the lower portion of the interior volume, lying on opposite sides of the baffles 50, is slowed by the presence of the baffles 50, the source liquid is (at least temporarily) corralled around the wick, and can be wicked more reliably.

FIG. 2B shows an end view of the aerosol source in FIG. 2A, looking into the tank 3 from the top. This shows the extent of the baffles 50 in this example; they each extend around roughly a quarter of the outer perimeter of the tank, and reach inwardly past the ends of the wick 6. Other arrangements might be chosen, comprising only one baffle or more than two baffles, and extending around a smaller or larger proportion of the tank circumference and reaching more or less far towards the inner wall 34. For example, a plurality of narrower baffles may be spaced all around the tank perimeter, or a single annular baffle might extend around the complete circumference. The baffles in effect reduce the bore of the tank at the level where they are located, reducing the speed at which source liquid can move past that point. This can be tailored according to requirements, overall tank and wick dimensions, wick porosity, and likely viscosity of the source liquid, for example. A balance may need to be made between the impeding effect provided by the baffles, and the need for liquid to be able to flow between regions separated by a baffle so that the full tank capacity can be properly utilized. Baffle dimensions might be selected such that for a cross-section through the tank at the level of a baffle or baffles, the cross-sectional area occupied by the baffle or baffles is in the range of 25% to 75% of the total cross-sectional area of the tank. In other words, a bore of the tank at that point, where the baffles are located, is reduced by 25% to 75% by the presence of the baffles, where the bore is the cross-sectional area of the tank through which the source liquid can flow. In other examples, the baffle or baffles may occupy a cross-sectional area in the range of 25% to 30%, or 25% to 40%, or 25% to 50%, or 25% to 60%, or 25% to 70%, or 35% to 40%, or 35% to 50%, or 35% to 60%, or 35% to 70% or 35% to 75%, or 45% to 50%, or 45% to 60% or 45% to 70%, or 45% to 75%, or 50% to 60%, or 50% to 70% or 50% to 75%, or 55% to 60%, or 55% to 70%, or 55% to 75%, or 60% to 70%, or 60% to 75%, or 65% to 70%, or 65% to 75% of the total cross-sectional area of the tank at the baffle location.

In the FIGS. 2A and 2B examples, the ends of the wick 6 are positioned over the baffles 50, so that there is a portion of each baffle at the end remote from the wall from which it protrudes that overlaps with the wick. This can help liquid to collect in a volume in the vicinity of the wick. The amount of overlap can be selected as desired, and can be achieved by adjusting the relative dimensions of the wick and baffles. For example, a long wick might be paired with a shorter baffle (one that protrudes less far from the wall), or a short wick with a longer baffle (one that protrudes further from the wall). To achieve a large overlap, both the wick and the baffles may be long. The wick may overlap a baffle by an amount in the range of 0% to 99% of a protruding dimension of the baffle (the direction along which the baffle extends from its supporting wall, typically a direction orthogonal to the wall). For example, the overlap may be in the range of 5% to 95%, 10% to 90%, 20% to 80%, 30% to 70%, 40% to 60%, 5% to 50% or 50% to 95%, for example. In the overlap dimension, the wick may be longer than the baffle, the baffle may be longer than the wick, or the wick and baffle may be substantially the same length. For example, the wick may have a length in the range of 5% to 95% of the baffle length (wick shorter than baffle) or the baffle may have a length in the range of 5% to 95% of the wick length (baffle shorter than wick).

Although FIGS. 2A and 2B show one pair of baffles at the same height, this should not be seen as limiting in any way. A single baffle might be used, or more than two baffles in a group at the same height, or baffles arranged at different heights (such as different positions along a longest dimension of the tank), either at random or in a pattern such as along a spiral, for example, and either in groups or individually. Baffles arranged at regular or irregular intervals along the tank could be used to decrease the liquid flow rate more evenly through the full extent of the tank, or to control the flow in a particular way, such as slowing it at or near more one or more wick locations. The locations of the baffles along the tank may be along a longest dimension of the tank, or along a tank dimension which is not the longest dimension for tanks of different shape or configuration.

Figure 3A:
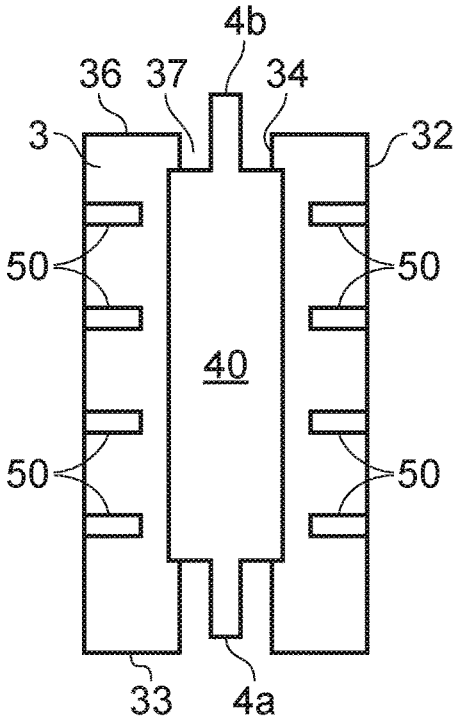
FIG. 3A shows a cross-sectional side view of a further example aerosol source incorporating baffles.

FIG. 3A shows a cross-sectional side view of an example aerosol source in which baffles spaced along the tank may be particularly useful. As in the FIG. 2 example, the tank 3 is again an annular space formed between an outer wall 32 and an inner wall 34, with the interior space of the tubular inner wall 34 providing an airflow channel 37. In this example, however, the rod-shaped wick and coiled heating element are replaced by an atomizer 40 in which a single entity provides both the wicking and heating functions. An electrically conductive mesh can be used for this, for example, where the conductive characteristic allows the atomizer to receive electrical power and heat up, while the mesh structure allows a wicking action. The atomizer 40 is again arranged across the airflow channel 37 with parts passing through the inner wall 34 into the interior volume of the tank 3. However, in this example, the atomizer 40 has an elongate planar configuration and is arranged such that its long edges reach into the reservoir, and its short ends are at each end of the airflow passage 37. These ends 4*a*, 4*b* are connected to the battery by appropriate arrangement of electrical conductors (not shown). Thus, a larger area of vaporizing surface is offered to air flowing through the airflow channel.

A consequence of this configuration is that the wicking edges of the atomizer 40 are present inside the tank 3 along much of the longitudinal extent of the tank. Therefore, multiple (in this case, four) pairs of baffles 50 are provided, spaced apart along the length of the tank 3. The baffles 50 protrude from the inner surface of the outer wall 32, as before. The presence of the baffles produces a moderating effect on the flow of liquid between ends of the tank and may partially confine liquid between adjacent baffles; this slowed and restricted movement helps to distribute the source liquid more evenly along the extent of the atomizer as the volume of source liquid in the tank decreases, giving more consistent wicking and vaporization over the full extent of the atomizer 40.

Figure 3B:
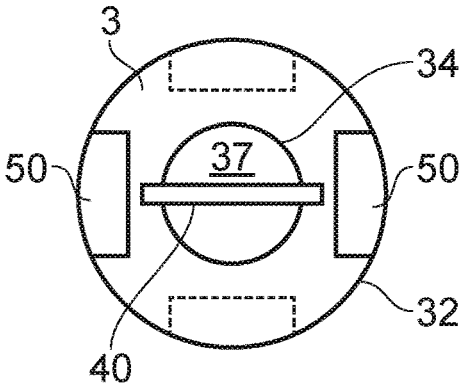
FIG. 3B shows a view from above of the example aerosol source of FIG. 3A.

FIG. 3B shows an end view of the aerosol source of FIG. 3A, looking into the tank from the top. The baffles 50 are shown oppositely arranged in pairs, in line with the plane of the atomizer 40. They might be positioned differently, such as orthogonally to the atomizer plane, as indicated by the dotted lines. Alternatively, the pairs may be staggered, such that some pairs are in line with the atomizer and alternate pairs are aligned orthogonally to the atomizer. This may force the source liquid to flow in a more serpentine path and decrease its rate of movement.

Four pairs of baffles are shown in this example, but more or fewer pairs may be used as convenient, and/or the baffles may be arranged other than in pairs.

Thus far, the example baffles have been substantially planar in shape, offering a flat surface to the liquid as it move through the tank, from a region on one side of a baffle to a region on the other side. Other shapes may be employed, however. Also, a baffle may be shaped so as to present surfaces to the flowing liquid which are the same for opposite directions of liquid flow (such as the FIGS. 2 and 3 examples in which both the "upper" and "lower" surfaces of the baffles are flat (planar)), or which are different for the two opposite directions.

Figure 4:
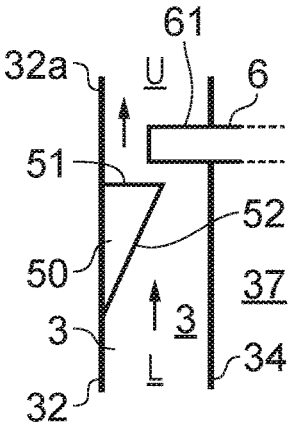
FIG. 4 shows a side view of an example baffle in an aerosol source.

FIG. 4 shows a side view of an example baffle 50 which has differently shaped opposite surfaces. For a flow of liquid substantially parallel to the plane of the wall 32 over which liquid may flow as shown by the arrows between an "upper" portion U of the tank interior and a "lower" portion L of the tank interior (where these directions are used for convenience having regard to the depicted orientation, but should be understood as non-limiting since the tank can be held in any orientation during use), the baffle presents two surfaces. A first surface 51 faces into the direction of liquid flowing from the upper portion U to the lower portion L and has a flat, planar surface, perpendicular to the flow direction. A second surface 52 is opposite to the first surface 51 and faces into the direction of liquid flowing from the lower portion L to the upper portion U. The second surface 52 has a sloped or tapering shape, so that the baffle 50 extends further into the tank at the end of the second surface which closest to the first surface. Hence the amount of protruding of the baffle 50 increases along the direction of fluid flow from L to U. This tapering shape presents a less immediate impediment to liquid incident upon it, so slows the rate of liquid flow less abruptly than the planar face 51. This shape can be used to encourage liquid movement more in one direction than in the other, such as to slow liquid more as it passes the wick location and less as it flows toward the vicinity of the wick. Thus, in the depicted example, the wick 6 has an end 61 inside the tank 3, and the baffle 50 is arranged under the wick 6 so that the planar side 51 faces the wick end 61, and the sloped side 52 faces away from the wick end 61. Liquid flowing from U to L is thereby impeded as it reaches the wick so as to increase the volume of liquid accessible for wicking, whereas liquid flowing from L to U can reach the wick more quickly if, for example, the user inverts the e-cigarette to redistribute the liquid as the tank becomes more empty.

Figure 5:
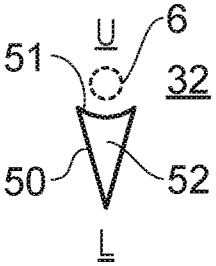
FIG. 5 shows a front view of another example baffle.

FIG. 5 shows a front view of an example baffle having a further type of shaped surface. In this depiction, the tank wall 32 from which the baffle 50 extends lies in the plane of the page, so the baffle 50 extends outwardly from the page. A lower surface 52 of the baffle 50 is tapered as in the FIG. 4 example; note that in this example the tapering is provided outwardly from the wall 32 as in FIG. 4, and also at the sides of the baffle 50. This presents a still less disruptive profile to liquid flow, so that liquid can more easily flow over the baffle 50 in the direction of increasing protrusion (from L to U in the depicted orientation). The opposite, upper surface 51 of the baffle 50 is provided with a concave shape in this example. Positioned under the wick 6 as shown, the concave shape aids in delaying the movement of liquid past the wick, to enhance absorption. The concavity can be in the plane parallel to the wall 32 as in the illustration, and may also be in the orthogonal direction so that the concave surface is bowl-shaped. Other and any concave shapes or generally recessed surfaces can be provided, such as a lip or collar around a rim of the relevant baffle surface. Any shaping that increases the impediment to liquid flow over the surface so as to at least temporarily retain more liquid at that location may be useful. Also, recessed surfaces may be otherwise than immediately adjacent to the wick location, and may be used elsewhere in the tank to modify liquid flow rates as desired.

Figure 6:
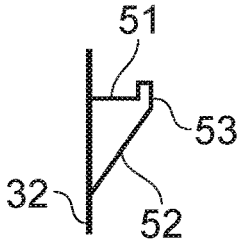
FIG. 6 shows a side view of a further example baffle.

FIG. 6 shows a side view of an example baffle 50 in which a surface 51 is made recessed by a lip 53 upstanding at the edge of the surface 51.

A selection of baffles of different shapes might be included inside a single tank. Where baffles having differently shaped opposite surfaces are used, the baffles may be differently oriented.

Figure 7:
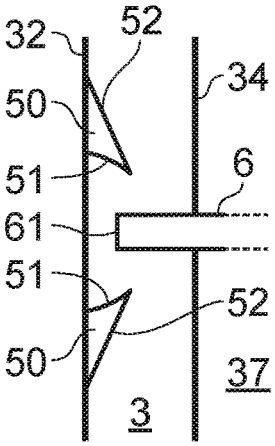
FIG. 7 shows a side view of example baffles in an aerosol source.

FIG. 7 shows a side view of baffles arranged according to such an example. Two baffles 50 are shown, each having a tapered surface 52 and an opposite concave surface 51. However, the baffles are oppositely oriented, so that for each the concave surface 51 faces an end 61 of the wick 6 (or other location or arrangement at which liquid is extracted from the tank for delivery for vaporization) and the sloped surface faces away from the wick end 61. Hence, for either direction of liquid flow over the baffles 50 and past the wick end 61, liquid movement is impeded around the wick end 61, creating a temporary "sub-reservoir" into which the wick reaches. This effect can be made more marked with a narrow tank bore and/or a more viscose source liquid, since surface tension will then have a more pronounced contribution. The lifespan of the sub-reservoir is thereby increased.

The examples presented thus far have shown baffles protruding from the inner surface of the outer wall of an annular tank. This is not a requirement, however, and the baffles may be placed on the inner wall. Also, baffles might be provided on both the inner and outer walls. So, in various, but non-limiting, examples, a tank may comprise one or more baffles protruding from the interior surface of the outer wall of an annular tank towards the inner wall of the annular tank, or may comprise one or more baffles protruding from the interior surface of the inner wall of an annular tank towards the outer wall of the annular tank, or may comprises one or more baffles protruding from the interior surface of the outer wall towards to inner wall and protruding from the interior surface of the inner wall towards the outer wall. An interior surface or inner surface refers to a surface bounding the interior storage volume of the tank, in which source liquid is held. Also, the tank need not be annular; baffles may be provided on an inner surface of other shapes of tank.

Figure 8:
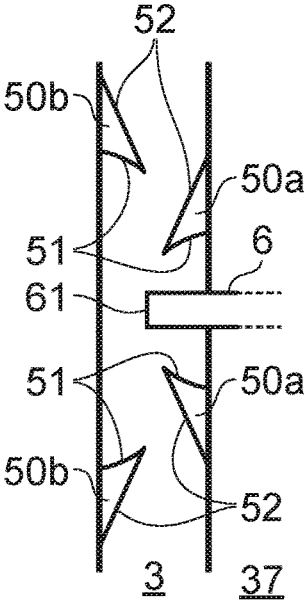
FIG. 8 shows a side view of still other example baffles in an aerosol source.

FIG. 8 shows a side view of baffles arranged in an example having baffles on inner and outer walls. Two baffles 50*a* protrude into the tank interior from the inner wall 34, and are positioned above and below the wick end 61, close to the wick 6. They are oppositely arranged so that each presents a concave surface 51 to the wick 6 and a tapered surface 52 away from the wick 6. Further from the wick location (so, in this example, longitudinally spaced away from the wick height along the length of the airflow channel over the wick) two more baffles 50*b* protrude into the tank interior from the outer wall 32, again having concave surfaces 51 facing towards the wick 6 and tapered surfaces 52 facing away from the wick 6. In an alternative, the tapered surfaces 52 of the more remote baffles 50*b* might face towards the wick, to direct liquid flow more towards the wick end. Both faces of the baffles 50*b* might be tapered in such an example.

Figure 9:
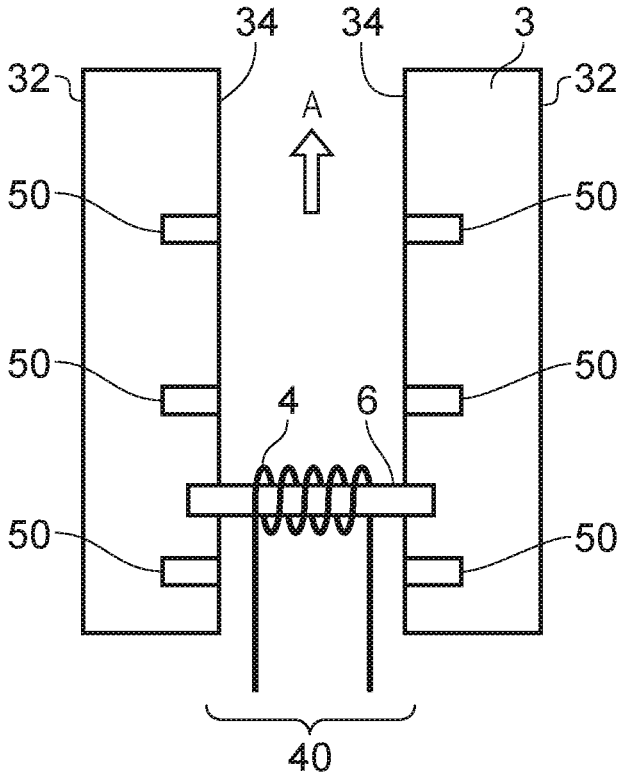
FIG. 9 shows a cross-sectional side view of an aerosol source with baffles according to a further example.

FIG. 9 shows a side view of an example tank having baffles on the interior surface only. The tank 3 is annular, similar to that of the FIG. 2A example, formed from an outer wall 32 surrounding an inner wall 34. An atomizer 40 comprising a wick 6 and a heating coil 4 is disposed in the air channel defined inside the inner wall 34. Other atomizer arrangements may be used instead in other examples. Three pairs of planar baffles 50 are arranged on the interior surface of the inner wall 34, so as to extend into the storage volume of the tank 3 and towards the outer wall 32. The baffles 50 are arranged in pairs diametrically opposite with respect to the airflow channel, with the two baffles 50 of each pair at the same height within the tank 3. Other positions, both symmetrical and asymmetrical may also be used, and the baffles 50 may be other than planar.

Substantially planar baffles such as the FIGS. 2 and 3 examples may have holes or opening therein. The size of the holes can be balanced against the total area of the baffle to modify the amount of impediment presented to moving liquid.

Further, baffles and like protruding and extending surface features for slowing, moderating, modifying, impeding and/or diverting liquid movement and flow can be incorporated into tanks and reservoirs of shapes different from the annular tanks discussed thus far. They can usefully be included into any shape, size and cross-sectional configuration of tank, and can be arranged to extend into the tank interior from any wall surface. Also, they can be used together with any atomizer, wick-and-heater arrangement or other vaporizing configuration, to at least temporarily increase the volume of source liquid able to be accessed for vaporization or otherwise improve the delivery of source liquid for vaporization from a partially empty tank. Some examples discussed above have pertained to tanks with an elongate shape and considered liquid flow along the tank length. Baffles might be positioned to impede flow across or around a tank as well or instead.

Baffles may be formed by being integrally molded with one or more walls of a tank, before assembling the walls to create the tank. This is a convenient manufacturing technique for walls made from plastics materials, for example. Tank walls may be made from other materials, however, such as metal or glass, or combinations of materials so that different walls or parts of walls of a single tank are made from different materials. For example, parts of a tank to be connected to other components such as a mouthpiece or battery section might be made from metal or an opaque plastic, with one or more side walls of the tank made from glass or transparent plastic so that the source liquid is visible from the exterior of the electronic cigarette. Integral molding may not therefore be suitable or convenient, in which case baffles can be formed separately and attached to the walls such as with adhesive or by soldering or welding (including laser and sonic welding). The baffles may be fabricated from plastics materials, metals or glass or any other suitable waterproof material that will not react with source liquid. Baffles might be formed by molding or machining, for example.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A liquid storage tank of an electronic vapor provision device, comprising:
   - one or more boundary walls defining an interior volume of the liquid storage tank in which liquid can be stored, the interior volume configured to be filled with source liquid to be vaporized in the electronic vapor provision device;
   - one or more baffles, the or each baffle protruding from an inner surface of the one or more boundary walls into the interior volume to impede a flow of the source liquid between portions of the interior volume between which the one or more baffles are located; and
   - one or more apertures in the boundary walls through which source liquid is delivered to a heating element, and wherein the one or more baffles are located such that they are able to at least temporarily corral source liquid around the one or more apertures, the one or more baffles acting to impede the flow of source liquid away from the apertures to hold back at least some of the source liquid so that it pauses in the vicinity of the one or more apertures.

2. The liquid storage tank according to claim 1, wherein the or each baffle is shaped such that a largest profile of the or each baffle lies in a plane non-parallel to a direction of the flow of the source liquid between selected portions of the interior volume.

3. The liquid storage tank according to claim 2, wherein the selected portions of the interior volume are spaced along a longest dimension of the liquid storage tank.

4. The liquid source tank according to claim 2, wherein the or each baffle is shaped such that the largest profile is orthogonal to the direction of the flow of the source liquid between the selected portions of the interior volume.

5. The liquid source tank according to claim 1, wherein the or each baffle is shaped to present a flat surface to the source liquid flowing between the portions of the interior volume.

6. The liquid source tank according to claim 1, wherein the or each baffle is shaped to present a concave or recessed surface to the source liquid flowing between the portions of the interior volume.

7. The liquid source tank according to claim 6, wherein the concave or recessed surface faces towards a location at which the source liquid is extracted from the liquid storage tank for vaporization.

8. The liquid source tank according to claim 1, wherein the or each baffle is shaped to present to the source liquid flowing between the portions of the interior volume a first surface and a second surface opposite to the first surface which is differently shaped from the first surface.

9. The liquid source tank according to claim 8, wherein one of the first surface or the second surface is sloped to protrude further from the inner surface closer to the other of the first surface or the second surface.

10. The liquid source tank according to claim 9, wherein the sloped surface faces away from a location at which the source liquid is extracted from the liquid storage tank for vaporization.

11. The liquid source tank according to claim 1, wherein the one or more baffles occupy a cross-sectional area which is in a range of 25% to 75% of a cross-sectional area of the interior volume of the liquid storage tank at a location of the one or more baffles.

12. The liquid source tank according to claim 1, wherein the two or more baffles are located at a same distance along a dimension of the liquid storage tank.

13. The liquid source tank according to claim 12, wherein the one or more baffles are arranged in at least two groups of two or more, the baffles in each group being located at a same distance along the dimension of the liquid storage tank.

14. The liquid storage tank according to claim 1, comprising at least two differently shaped baffles.

15. The liquid source tank according to claim 1, wherein the one or more boundary walls comprise an outer boundary wall and an inner boundary wall that therebetween define an annular interior volume.

16. A vapor generating component for an electronic vapor provision system comprising the liquid storage tank according to claim 1 and an atomizer assembly configured to extract, receive and vaporize the source liquid from the liquid storage tank.

17. The vapor generating component according to claim 16, wherein the atomizer assembly comprises a heating element and a wick component to deliver the source liquid from the liquid storage tank to the heating element for vaporization, wherein the electrical heating element and the wick component are one of separate entities or the same entity.

18. An electronic vapor provision system comprising a liquid storage tank, the liquid storage tank comprising:

one or more boundary walls defining an interior volume of the liquid storage tank in which liquid can be stored, the interior volume configured to be filled with source liquid to be vaporized in the electronic vapor provision device;

one or more baffles, the or each baffle protruding from an inner surface of the one or more boundary walls into the interior volume to impede a flow of the source liquid between portions of the interior volume between which the one or more baffles are located; and one or more apertures in the boundary walls through which source liquid is delivered to a heating element, and wherein the one or more baffles are located such that they are able to at least temporarily corral source liquid around the one or more apertures, the one or more baffles acting to impede the flow of source liquid away from the apertures to hold back at least some of the source liquid so that it pauses in the vicinity of the one or more apertures.

19. A liquid storage tank for an electronic vapor provision system comprising:

one or more walls defining a storage volume for holding source liquid;

one or more protruding elements each extending from an inner surface of a wall into the storage volume such that a bore of the liquid storage tank at a level of the one or more protruding elements is reduced by at least 50% by a presence of the one or more protruding elements so as to inhibit a flow of the source liquid along the bore; and one or more apertures in the boundary walls through which source liquid is delivered to a heating element, and wherein the one or more protruding elements are located such that they are able to at least temporarily corral source liquid around the one or more apertures, the one or more protruding elements acting to impede the flow of source liquid away from the apertures to hold back at least some of the source liquid so that it pauses in the vicinity of the one or more apertures.

20. An electronic vapor provision system or a component therefore comprising a liquid storage tank, the liquid storage tank comprising:

one or more walls defining a storage volume for holding source liquid;

one or more protruding elements each extending from an inner surface of a wall into the storage volume such that a bore of the liquid storage tank at a level of the one or more protruding elements is reduced by at least 50% by a presence of the one or more protruding elements so as to inhibit a flow of the source liquid along the bore; and one or more apertures in the boundary walls through which source liquid is delivered to a heating element, and wherein the one or more protruding elements are located such that they are able to at least temporarily corral source liquid around the one or more apertures, the one or more protruding elements acting to impede the flow of source liquid away from the apertures to hold back at least some of the source liquid so that it pauses in the vicinity of the one or more apertures.

* * * * *